United States Patent [19]
Keseru et al.
[11] 4,196,700
[45] Apr. 8, 1980

[54] BOILER, PRIMARILY FOR WARM-WATER FLOOR HEATING

[75] Inventors: Béla Keserü, Budapest; Mihály Juhász, Erdliget, both of Hungary

[73] Assignee: Tötkomlösi Vegyesipari Szövetkezet, Tötkomlös, Hungary

[21] Appl. No.: 909,962

[22] Filed: May 26, 1978

[30] Foreign Application Priority Data

May 27, 1977 [HU] Hungary ..... KE 1008

[51] Int. Cl.² ..... F22B 1/06
[52] U.S. Cl. ..... 122/406 R; 122/235 C
[58] Field of Search ..... 122/235 R, 235 C, 235 K, 122/406 R

[56] References Cited

U.S. PATENT DOCUMENTS

| | | | |
|---|---|---|---|
| 2,860,612 | 11/1958 | Durham | 122/406 |
| 2,962,004 | 11/1960 | Vorkauf | 122/406 |
| 2,994,308 | 8/1961 | Stabenow | 122/406 |
| 3,020,895 | 2/1962 | Vorkauf | 122/406 |

*Primary Examiner*—Edward G. Favors
*Attorney, Agent, or Firm*—Karl F. Ross

[57] ABSTRACT

A boiler for hot-water heating which is of rectangular cross section in vertical and horizontal planes and which comprises only two horizontal headers located on diagonally opposite sides of the fire chamber and connected by a first array of spaced apart parallel bent tubes forming the roof and one longitudinal side wall of the boiler chamber and with a second array of spaced apart bent tubes forming the other side wall and floor of the chamber. Additional tubes can be provided along the front and rear walls and slotted openings toward the rear of the boiler form passages traversed by the exhaust gas. The water return is connected to the lower header while the hot water supply pipe is connected to the upper header.

8 Claims, 7 Drawing Figures

BOILER, PRIMARILY FOR WARM-WATER FLOOR HEATING

FIELD OF THE INVENTION

The invention relates to a boiler which can be used primarily for hot-water floor heating of private homes, small business buildings, communal installations and the like. The boiler of the invention can be operated first and foremost with oil, although about the same with gas or with solid fuels, e.g. coal.

BACKGROUND OF THE INVENTION

Up to now section boilers of cast iron or steel plate have been predominantly used for such purposes.

The cast-iron boilers have a high consumption of materials and foundry capacity and because of their high weight are disadvantageous with respect to transport and storage; their repair is complicated. The water paths are of limited cross section and have many direction changes as a result of which, from the viewpoint of circulation, the boiler has a high friction or deflection flow resistance. Because of the high wall thickness, the heat transfer is unsatisfactory and the specific heat transfer coefficient is small. The fabrication cost and thus the cost to the consumer of the cast iron is high. The output of such boilers ranges within narrow limits, e.g. 10 to 20% of the nominal output. Even minor changes in heat requirements necessitate an increase in the number of sections or the size thereof. This is accompanied by a corresponding cost increase in the mounting work.

Steel-plate boilers are constructed in lying or upright configurations. The first have a fire chamber of rectangular or circular cross section and a horizontally arranged burner unit; the latter have a fire chamber of circular cross section and burners mounted at the upper portion.

The partition walls of the boiler in its lying configuration are planar surfaces and either stiffening structures must be used to satisfy strength requirements, or greater wall thicknesses must be selected than may be desirable from the standpoint of the thermal technology. The stiffening gives rise to more complicated fabrication, a higher resistance from the point of view of flow technology, an indeterminate and uncalculatable circulation and, for safety reasons, a reduced specific thermal loading. The higher wall thicknesses, apart from a high cost of materials, result in unsatisfactory heat transfer. The volumetric efficiency of the fire chamber of rectangular cross section is unsatisfactory from the standpoint of the flame. The exhaust gas path has many directional changes and thus a high flow resistance for the exhaust gas. The heat transfer is unsatisfactory because of the planar surfaces, the water scale incrustation on the water side is greater and, as a result, the heat transfer is poor. The dimensions of such boilers are, because of the enumerated disadvantages—with respect to the heat output—fairly large.

With boilers of the upright construction, the boundaries of the radiant and convective heating surfaces create difficulties during the fabrication. For a corresponding state of firing conditions, additional metal-partition walls must be built in with increased labor cost. These walls are subjected to high heat and corrosive effect and should thus be fabricated from better quality materials of greater cost than would otherwise be necessary. The boiler requires costly insulation; its output and its efficiency are low.

OBJECT OF THE INVENTION

The object of the invention is the provision of a boiler of low weight and material cost, of high efficiency and reduced special requirements, which does not manifest the disadvantageous characteristics of known multi-stage boilers.

SUMMARY OF THE INVENTION

The invention is based upon the recognition that, in the case in which the fire-chamber wall of the boiler is not formed from flat sheet metal but is formed from tubes tranversed by water to be heated in a direction transverse to the flow direction of the exhaust gases, the heat transfer conforms to the heat distribution, and the flow losses of the exhaust-gas path are reduced to a minimum and because of advantageous fabrication-technological and structural characteristics, a maximum heat output and high firing and heating efficiencies can be assured.

Based upon this realization, the aforestated object is achieved according to the invention with a boiler whose fire chamber has associated therewith upright membrane walls formed from water-conducting tubes, manifolds and inlet and outlet ducts connecting therewith, as well as an exhaust-gas discharge opening, and [the boiler] being characterized in the the walls bounding the fire chamber are at least in part composed of water-conducting tubes which extend transversely to the flow direction of the exhaust gas in the fire chamber while the manifolds are disposed in a spaced relationship one over the other in a horizontal position substantially parallel to the flow direction of the exhaust gas, the return-side lower manifold being connected with the inlet-side upper manifold.

According to an advantageous feature of the invention, the side walls of the fire chamber contain arcuately connected preferably mutually perpendicular straight stretches of tubes which define with the spaced apart vertically and also horizontally offset manifolds, a fire chamber which is substantially rectangular in cross section with rounded-off corners.

According to a further advantageous characteristic of the invention, the return conduit and inlet or feed conduit of the heating system open in the region of the maximum specific heat loading of the fire chamber heating surfaces into the manifolds or extend outwardly therefrom.

According to yet another advantageous feature of the invention, slit-like exhaust gas discharge openings are formed in the rear wall of the boiler, occupying a portion of the height of the boiler chamber, although advantageously not exceeding a third of the height, the openings being bounded by arc-shaped surfaces. It is also advantageous if the boiler has a tapering tubular piece, preferably a connecting fitting which converges from the row of openings in the direction in which the exhaust gas passage opens into the latter, this tubular piece being advantageously trapezoidally shaped as seen from above; advantageously this tubular piece extends over the full width of the boiler chamber which is provided with the exhaust gas discharge openings preferably over the full width of the boiler.

Another embodiment according to the invention is characterized in that between the fire chamber and the rear wall, there is built in at least one advantageously vertical partition wall which runs transversely in the upper portion of the boiler. Arcuate surface form slit-like exhaust-gas openings occupying a portion of the boiler height preferably less than a third of the latter, and run in a row across the breadth of the boiler chamber. With a boiler with oil or gas firing, between the partition and the rear wall, advantageously another guide wall is provided with exhaust gas discharge openings formed on a lower portion thereof.

The boiler according to the invention has an advantageous effect by comparison with the conventional system known heretofore and which will be described below.

Since the exhaust gas does not flow along planar walls and is not parallel to the water flow but transverse thereto, the boiler has an exceptional heat transfer coefficient. Because of the reduced wall thickness the heat conduction coefficient of the boiler is high.

The specific heat loading of the fire-chamber heating surfaces is substantailly higher than that of the multistage boilers known heretofore. About 85% of the thermal energy supplied in the fire chamber, thus its major part, is transferred to the water through the fire-chamber surfaces by total radiation and convection. As a consequence, with reduced area a high heat transfer is effected and the exhaust gas outlet temperature so that only a mimimal convection heat area need be built in. Thus the overall size (volume and weight) of the boiler is substantially below the weight of the multistage boiler known heretofore.

Because of the reduction in flow losses to a mimimum, the drawing requirement or draft is satisfactory. With boilers with an effective heat capacity to about 60,000 kcal/hr, the requisite draft amounts to 2 to 3 mm (water column); with heat capacity circa 150,000 kcal/hr the draft requirement is 3 to 4 mm (water column). The requisite smokestack height in the first case amounts to 4 to 6 m, in the latter case 6 to 8 m; the smokestack height can thus be matched to the building height.

The heating and firing parameters of the boiler are likewise remarkable. With oil, the $CO_2$ value amounts to about 14.8% , the $CO_2$ (max) value to about 15.5%, the air-surplus value also lies below 105%. The heat content and the temperature of the exhaust gas emerging from the firing chamber can be held to very low optimum values of about 160° C. to 180° C. This presupposes that the exhaust-gas side losses can be reduced to a minimum with limited incorporation of convective heat surfaces. With such a reduced exhaust-gas outlet temperature and an insulated boiler body, the heat loss is minimal, the boiler efficiency amounting to 91% to 92%, thereby significantly exceeding the efficiency of 85% to 86% of boilers of the most modern construction known heretofore.

The strength characteristics of the boiler are exceptional. The usual pressure of 40 m (water column) does not require wall thicknesses of hot-water pipes in excess of 0.5 mm. Since fabrication of the boiler generally does not permit the use of pipes with a wall thickness less than 2.5 mm, the acceptable corrosion penetrability can be increased from the customary value of 1 mm to a value of more than 2 mm. As a result, the strain on the material of the boiler is relatively small, its life is long and its safety at a maximum.

A further advantage of the boiler of the invention is that the number of sudden direction changes and cross section changes is 40% to 50% less than with conventional constructions, i.e. the baffling resistance of the boiler is low relative to the conventional.

The circulation of the boiler can also be determined by calculation and a heat transport can be adapted to heat distribution of the fire chamber. The circulation is determined so that the heat loading of the heating surfaces is suitable so that a detrimental excess of thermal stressing of the heating surfaces cannot occur. The connecting fittings of the feed and return pipes lie in the centerline of maximum water throughput, thereby giving not only an advantage from the point of view of heating technology, but also contributing to a reduction in the number of direction changes hence minimizing the baffling resistance.

In the flow connections between the boiler and the remaining multistage heating system, the height of the centerline of the boiler over the ground is substantially lower, the distance between the centerline of the feed duct and the heat body substantially greater than with conventional multistage or hot-water boilers which is advantageous for heating at a high pressure level. This ensures an effective heat transport and intensive circulation so that centerline heating systems of one to two story buildings (private homes, cooperative housing, communal buildings, etc.) without requiring the inclusion of a circulating pump to achieve a sufficiently highly effective pressure.

The boiler of the invention is also constructed advantageously from the point of view of manufacturing technology. A factory of average size, qualified for the requisite welding work and pipe bonding, can without additional capital cost be modified for the serial production of the boilers of the invention. The pipe need only be stocked in two or three sizes, thereby simplifying the material requirements and permitting mechanization to a minimal degree to make possible automation of the manufacturing process.

The capacity of the boiler of the invention can be varied within a wide range. A change in type is only required when the desired power exceeds the nominal power of the boiler by about 50%. The heat service of dwellings and communes can thus be increased by about 50% from the original by the use of the boilers of the invention without replacing them.

In the exhaust-gas path of the boiler, the cross section is a multiple of the cross sections of conventional multistage or hot-water boilers. This is likewise an important factor in increasing the heat output and the attainment of an exhaust gas outlet pressure of 160° C. to 180° C. which is optimum from base efficiency.

BRIEF DESCRIPTION OF THE DRAWING

The invention will be expounded upon below with respect to an embodiment.

In the drawings show.

SPECIFIC DESCRIPTION

Figure 1:
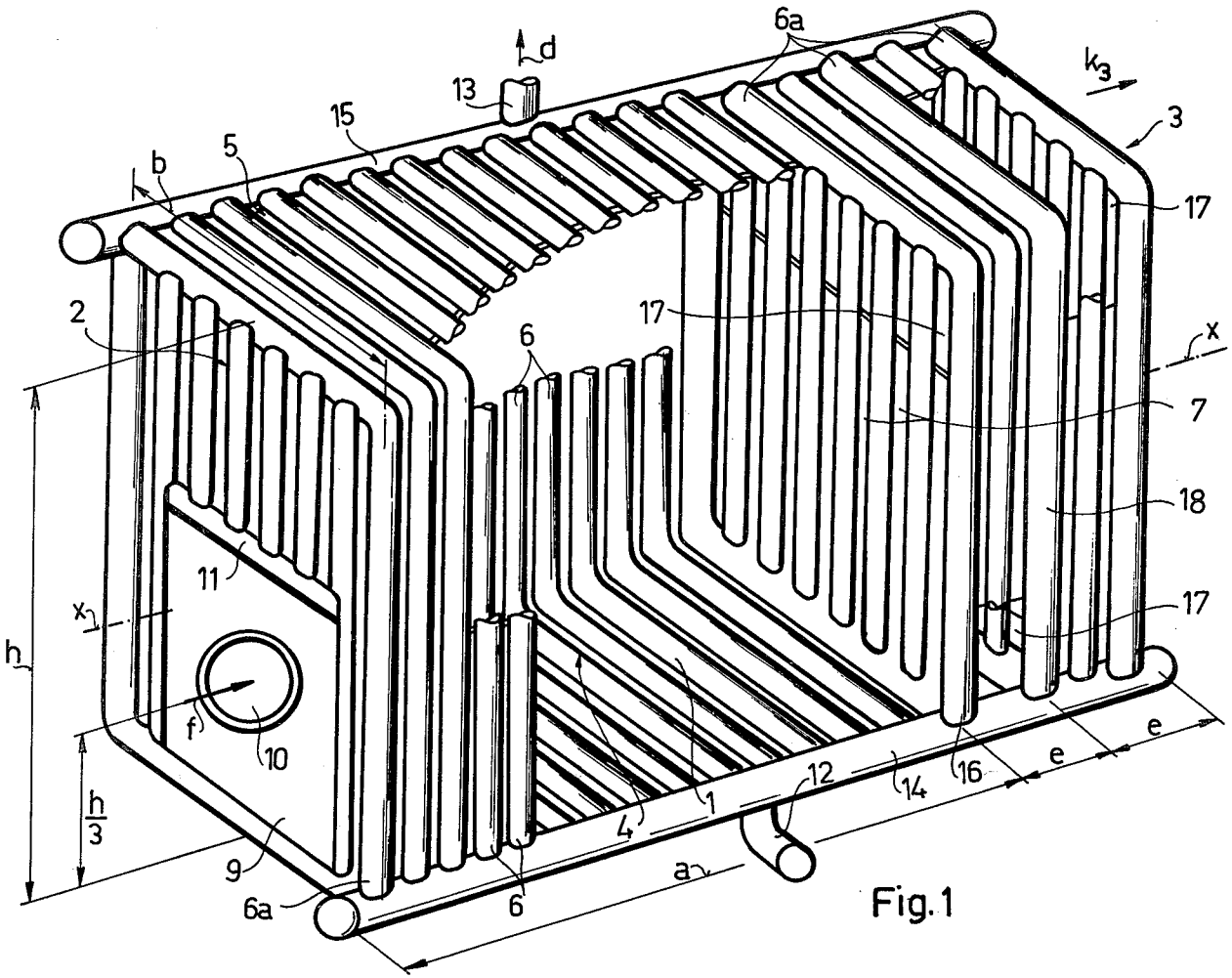
FIG. 1 a perspective view illustrating a boiler according to the invention with oil firing with part of the boiler walls shown removed.
Figure 7:
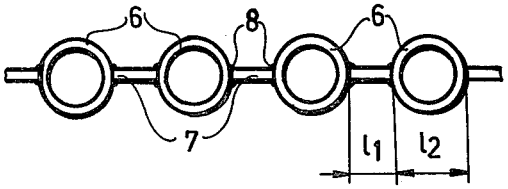
FIG. 7 a detail of half of the boiler according to FIGS. 1-2 and 4-6 in horizontal section and in enlarged scale.

The fire chamber [fire box] 1 of the boiler according to FIG. 1 is bounded by a front wall 2, a rear wall 3, as well as side walls 4 and 5. All of the walls are fabricated from tubes 6 and from sheet metal strips 7 connecting the tubes together (FIG. 7). The tubes 6 can be steel tubes or tubes of alloyed material and are connected with the sheet metal strip 7 by means of weld seams 8. It is advantageous for the breadth $1_1$ of the sheet metal strips 7 to be smaller than the external diameter $1_2$ of the tube 6. The tubes 6 and the sheet metal strips 7 form naturally a closed interconnected surface which constitutes a membrane wall.

In the front wall 2, an oil burner 10 known per se is built into a front plate 9. The oil burner 10 is disposed in the lower third of the inner height h of the fire chamber 1 and of half of its width b. The front plate 9 is closed by a horizontal pipe 11 from above.

Figure 5:
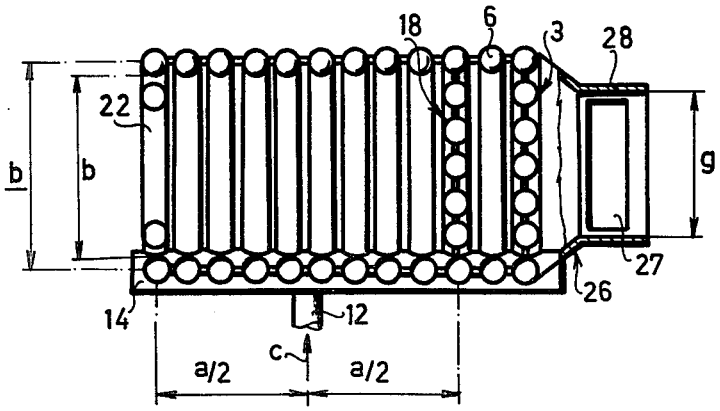
FIG. 5 a horizontal section along the line B—B in FIG. 4.

The tubes and sheet metal strips of side walls 4 and 5 consist of bent tubes 6 and sheet metal strips 7. Each member consisting of a bent tube and a sheet metal strip, comprises parts which are perpendicular to one another and are rounded off along circular arc so that one part is vertical and the other part, to the contrary, is horizontal. The length of the vertical parts exceeds the lengths of the horizontal parts. This means that the inner cross section of the fire chamber 1 has substantially the form of an upright rectangle (FIG. 5). The bent regions of the side walls 4 and 5 are disposed diagonally opposite one another as seen in cross section.

At the other two diagonally opposite corners of the rectangle, two manifolds 14 and 15 extend along the fire chamber 1. The return duct 12 of the heating system opens into the manifold 14 while the supply conduit 13 of the heating system extends out of the manifold 15.

The tubes 6 of the side walls 4 and 5 connect the manifol 14 of the return line 12 with the manifold 15 of the supply conduit 13; they run therefore transverse to the flow direction Y of the exhaust gas flows $k_1$, $k_2$ (FIG. 2) and form instead of smooth surfaces, inner firing chamber heat transmission surfaces of half tubes with projecting ribs. At such surfaces the heat transmission is considerably more intensive than at smooth surfaces. The side walls 4 and 5 of the fire chamber are radiation surfaces, i.e. the heat is transferred by radiation to the water which flows in the tubes 6 which form these walls. The heating system containing the cast iron or sheet metal heating body can be known system working with pumps or with gravitation.

The axes $Y_1$ and $Y_2$ of the return duct 12 and the supply conduit flow suitably in the same vertical plane in the manifold 14 and 15. This plane in the example shown runs in the center of a length a of the fire chamber 1, but can also be found elsewhere. Naturally, it is most advantageous when the supply conduit and the return conduit flow into or leave from the manifolds 14 or 15 within the area of the maximum specific heat load T of the fire-chamber heating surfaces. Arrow c shows the course of the cold water, arrow d the exit direction of the water heated in the boiler.

Figure 6:
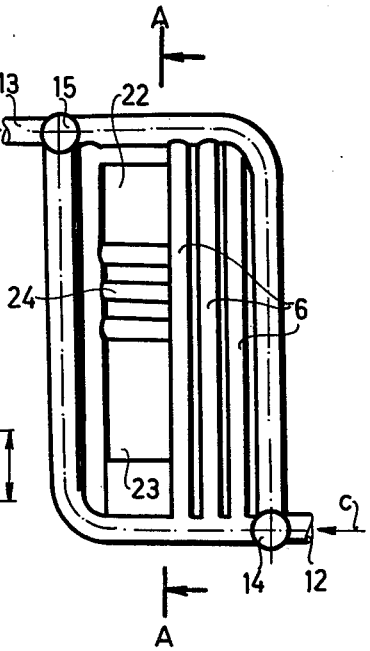
FIG. 6 the boiler according to the invention with one half shown in elevation in the direction C of FIG. 4, the other half in section along the line D—D in FIG. 4.

The fire chamber 1 is shut off according to FIG. 6 on the side opposite the front wall 2 by a vertical separating wall [partition] 16 perpendicular to the axis x of the boiler. Somewhere in the upper third of this separating wall the metal strips 7 are cut out (see also FIG. 6), as a consequence of which elongated slit-type openings 17 form between the neighboring vertical tubes 6. At spacings e from the separating wall 16 and the rear wall 3 a guide wall 18 runs between these walls, in whose lower third the metal strips 7 are cut out, so that the openings 17 are located down here. The rear wall 3 and the separating wall 16 are shaped similarly, i.e. the slit-type openings 17 are located in both cases in the upper third. With boilers of larger capacity the form of the walls 16, 18 as well as 2 and 3, tubes **6*a* running along the periphery of the vertical walls is identical with those of the tubes 6**, their diameter is, however, larger. With boilers of lesser capacity the diameters of all circulation tubes are the same.

Figure 2:
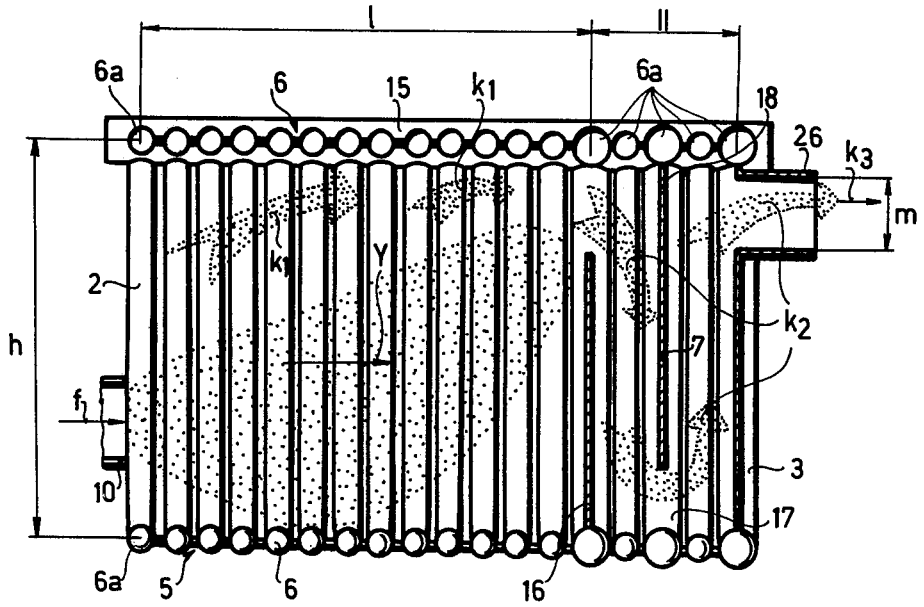
FIG. 2 a vertical section according to line X—X of FIG. 1.

The boiler according to the invention works as follows:

The flow of the hot exhaust gases from the oil burner 10 into the fire chamber occurs in the direction of arrow f while the water to be warmed flows in the direction of arrow c into the manifold 14, from there it flows into the bent tubes 6 which constitute the side walls 4 and 5, then from here into the manifold 15 of the supply conduit 13. The exhaust gas tranverses the boiler as shown in FIG. 2, the flow pattern is well demonstrated by the dotted arrows $k_1$, $k_2$. In FIG. 2 the radiation area of the boiler—for the most part equivalent to the fire chamber—is designated with reference No. I as compared to the region of the convective heat transfer shown with reference No. II. The exhaust gas stream is shown with arrows $k_1$, with which the heat is transmitted to the walls 4 and 5 by jet, whereby the arrows $k_2$ show the convective heat delivery. The water heated in this way in the tube walls is maintained in circulation in the heating system by means of methods which are known per se. The exhaust gases leave the boiler in the direction of the arrow $k_3$.

In FIG. 1 it is easily recognizable that the elongated, vertical, slit-type openings 17, which are provided in all three transverse walls—in the separating wall 16 and the guide wall 18 as well as the rear wall 3—run between tubes with circular cross section, i.e. between rounded, arcuate surfaces; the flow losses and with it also the draft requirements are as a result minimal. The openings 17 are arranged with spacings and parallel to one another, whereby they change the turbulent exhaust gas flow into a laminar flow.

Figure 4:
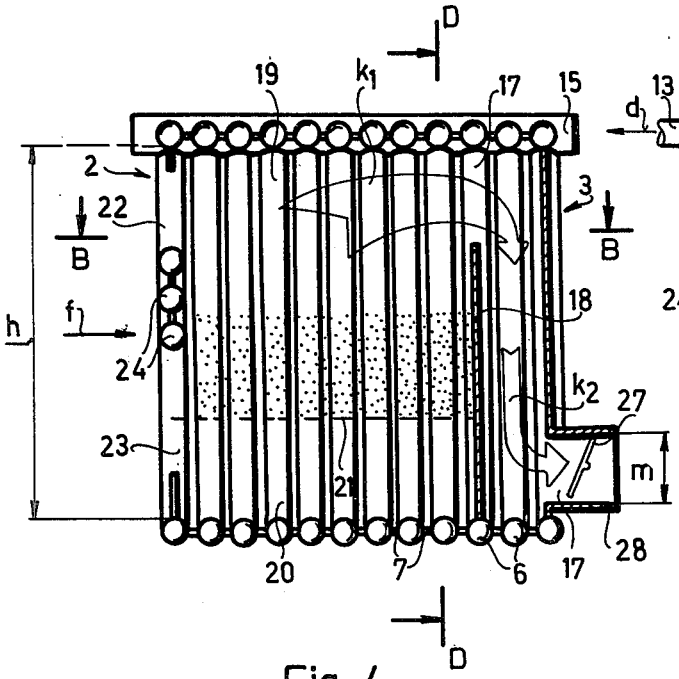
FIG. 4 a boiler according to the invention with coal firing, in section along the line A—A in FIG. 6.

To the openings 17 in the rear wall 3 a connecting fitting emanating from the entire width of the boiler is connected (this connecting bolt 26 is especially easy to see in the embodiment according to FIGS. 4 and 5), which connects the openings 17 with the exhaust gas channel 28 of the boiler. The laminar character of the gas flow results in a further important factor in lowering the flow losses and the drawing requirements to a minimum, which contrarily is a presupposition for the determination of the technical firing optimal limitations; fire chamber pressure equals zero, a flow in cross section which is almost homogeneous, a complete mixture of fuel (oil or gas) and air, a low air excess, a good flame filling degree, an optimal burning speed, and as a result of all of these factors, a complete combustion.

Figure 3:
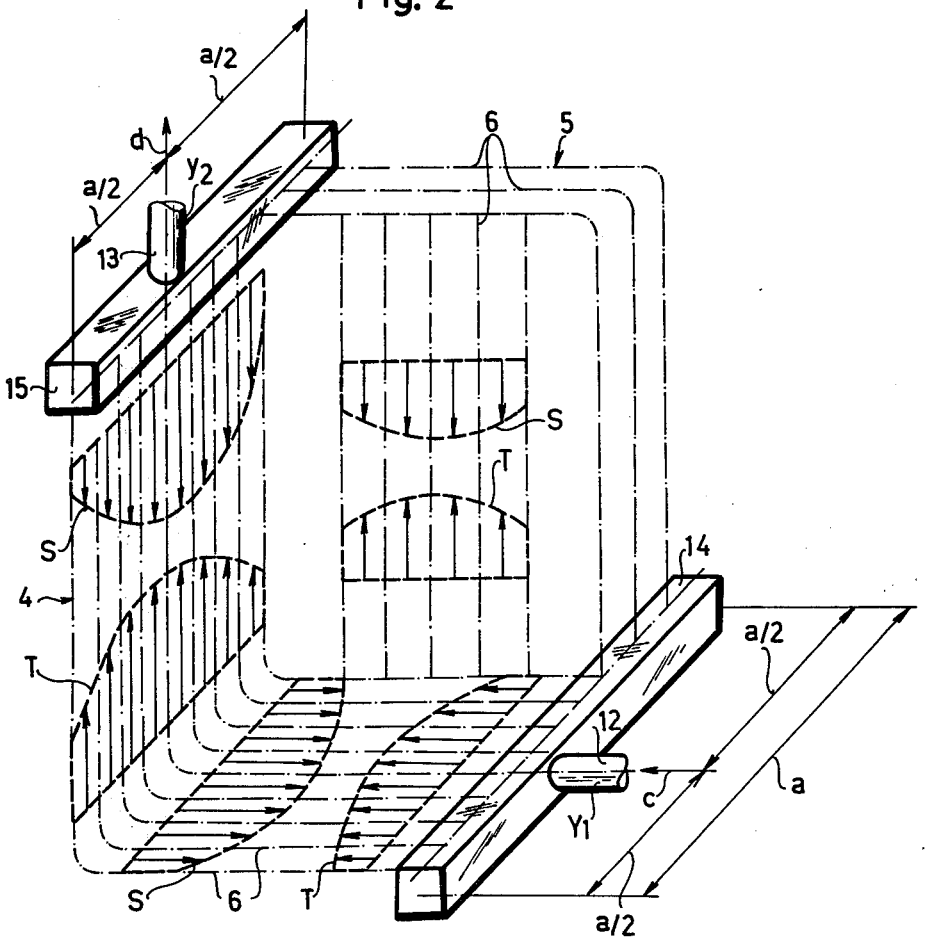
FIG. 3 in perspective diagram, the heat loading and heat transport relationship in a boiler according to the invention.

In FIG. 3 the curves of the specific heat load, as well as that for size and distribution of heat transport of the fire chamber heating surfaces of the boiler are shown. The manifolds 14 and 15 and the connecting return duct 12 and the supply conduit 13 of the boiler are also shown here; the tubes 6 in contrast are shown only in part and by means of dot-dash line. The form of the curve S of the specific heating load is for the most part similar to the form of the curve T, which represents the measurement and distribution of the heat transport. That means that maximum temperature of the fire chamber heating surfaces is to be found where the water throughflow (the water speed) is the largest in the tubes 6. This follows since the tube 12 and the tube 13 are connected respectively to the manifold 14 and the manifold 15 in the center of the manifold. The tube axes $Y_1$, $Y_2$ are located in the bisected line of the length a of the manifolds, i.e. the entrance locations of the supply and return conduit fall into the middle line of the highest water throughput and the temperature of the exiting exhaust emitted from the oil burner 10 is maximal in the center region of the fire chamber 1. As the fire chamber temperature changes from the center along the longitudinal direction, (in the direction of the centerline X—X) i.e. decreases toward both ends of the fire chamber, thus does the water throughput and with this naturally also the heat transport to both sides of the center decrease. For example the exhaust gas temperature when arriving at the separating wall 16 amounts to 550°-600° C., whereas when exiting from the boiler the temperature amounts to 160°-180° C.

In FIGS. 4-6 a boiler according to the invention is shown with coal firing, whose basic structure is identically shown with that of FIG. 1; the same construction elements are therefore marked with the reference numbers already used. Here the fire chamber 19 is formed over the grate 21, under which an ash chamber [box] 20 is located. In the front wall 2 doors 22 and 23 are formed, which are separated from one another by means of front sided horizontal transverse tubes 24. The door 22 is located on top, as compared with the door 23 which is below, through the former the coal reaches the affixed grate 21 in the fire chamber 19, through the latter the ashes can be removed from the ash box 20. In the part of the boiler opposite the doors 22, 23—in the flow direction toward the end of the fire chamber 19—there is likewise a built-in separating wall 16, equipped on top with openings 17. The openings 17 are located below in the rear wall 3, and the exhaust gases exit here from the convective heat transmission region. As regards structure, function as well as advantages this embodiment is comparable with the model form already completely described in connection with the FIGS. 1-3 and 7. In FIGS. 4-5 the connection fitting 26 which guides the exhaust gases and is connected from outside with the openings 17 of the rear wall 3 easily recognized. The width of this fitting in the rear wall 3 is equal to the width b of the boiler, from there the fitting narrows when looking from above at the width g of the exhaust channel 28, in which a flap 27 is also built in. The height m of the connecting fitting 26 is for the most part identical with the height m of the slit-type openings in the rear wall 3. By means of the construction of the exhaust gas diversion the flow losses can be considerably lessened, which again leads to lessening of the drawing requirement; the latter however is an important condition for creating of optimal technical firing conditions in the fire chamber. Note that the exhaust gas diversion in this embodiment is made as per FIGS. 1 and 2, only the connecting fitting 26 is there connected to the upper part of the rear wall 3, since the openings 17 are located there. The taper of the connecting fitting 26 is not to be seen in FIG. 1 since it is covered by other parts.

The invention is naturally not limited to the embodiments shown as examples, but can be realized within the patent scope defined by the claims. Note, as regards the form of the oil or gas flame a circular fire room cross section can be considered ideal. In this case the horizontal manifolds of the supply and return conduits lie in the same vertical plane and the side walls of the boiler are formed by those semicircular-formed water guiding tubes which flow into this manifold. Carrying out this solution is however tied in with technical production difficulties, but in certain cases its advantages cannot be denied.

We claim:

1. A boiler for producing hot water, especially for hot water heating, comprising:

a structure of rectangular horizontal and vertical cross sections, said structure being constituted by a single upper header and a single lower header, said headers extending horizontally along diagonally opposite corners of the structure, a first array of mutually parallel right-angle bent tubes defining a roof and one vertical longitudinal wall of the structure, a second array of mutually parallel right-angle bent tubes forming a floor and a second longitudinal vertical wall of said structure, each of said tubes communicating at its ends with said header, and further tubes defining front and rear walls of said structure and communicating with tubes of said first and second arrays at opposite ends of the structure whereby said walls, said roof and said floor define a combustion chamber within said structure;

means at said rear wall for discharging the combustion gas from said chamber whereby the tubes of said arrays all lie transverse to the flow direction of said gas as it traverses said chamber;

means for generating a combustion gas in said chamber;

means connected with said lower header for returning water to be heated thereto; and means connected with said upper header for drawing hot water therefrom.

2. The boiler defined in claim 1 wherein all of the bends of the pipes of said array are arcuate.

3. The boiler defined in claim 2 wherein the means for generating combustion gas in said chamber includes a burner mounted in said front wall at the lower third of the chamber and at half the width thereof.

4. The boiler defined in claim 2 wherein the means for generating the combustion gas in said chamber is a grate for receiving a layer of coal, said boiler further comprising an ash-collecting chamber disposed below said grate.

5. The boiler defined in claim 2 wherein said rear wall is formed with slot-shape openings extending over only the upper third of the height of said chamber and defined between arcuate vertical surfaces for discharging the combustion gas.

6. The boiler defined in claim 5 wherein the means for discharging gas from said chamber includes a rearwardly converging fitting communicating with said opening and having a trapezoidal configuration in plan view.

7. The boiler defined in claim 5, further comprising a partition formed by tubes spanning horizontal stretches of a tube of each of said array, said partition being formed along its upper rear third with slots defined between arcuate tube surfaces whereby said partition forms a baffle for gases traveling to the openings in said rear wall.

8. The boiler defined in claim 7, further comprising a guide wall formed by tubes and provided with openings along a lower portion of this guide wall, said guide wall being disposed between said partition and said rear wall.

* * * * *